US008474189B1

(12) United States Patent
Peterson et al.

(10) Patent No.: US 8,474,189 B1
(45) Date of Patent: Jul. 2, 2013

(54) WEATHER STRIP FOR USE WITH FRAME STRUCTURES HAVING SHARP CORNERS

(75) Inventors: James L. Peterson, Woodbury, MN (US); Joel T. Rhode, St. Paul, MN (US)

(73) Assignee: Intek Plastics, Inc., Hastings, MN (US)

( * ) Notice: Subject to any disclaimer, the term of this patent is extended or adjusted under 35 U.S.C. 154(b) by 1021 days.

(21) Appl. No.: 12/244,130

(22) Filed: Oct. 2, 2008

(51) Int. Cl.
*E06B 7/22* (2006.01)

(52) U.S. Cl.
USPC ..... 49/498.1; 49/479.1; 49/489.1

(58) Field of Classification Search
USPC ..... 49/475.1, 479.1, 489.1, 492.1, 498.1
See application file for complete search history.

(56) References Cited

U.S. PATENT DOCUMENTS

| | | | | |
|---|---|---|---|---|
| 3,656,260 | A | 4/1972 | Weaver et al. | |
| 4,510,715 | A | 4/1985 | Giguere | |
| 4,532,260 | A | 7/1985 | MacKeighen et al. | |
| 4,600,728 | A | 7/1986 | MacKeighen et al. | |
| 4,807,397 | A | 2/1989 | Doan | |
| 4,898,760 | A | 2/1990 | Halberstadt et al. | |
| 5,269,101 | A | 12/1993 | Nozaki et al. | |
| 5,347,759 | A | 9/1994 | Kobayashi et al. | |
| 5,393,796 | A | 2/1995 | Halberstadt et al. | |
| 5,512,601 | A | 4/1996 | Halberstadt et al. | |
| 5,686,165 | A | 11/1997 | Cook | |
| 5,927,029 | A | 7/1999 | Ngoc | |
| 6,221,964 | B1 | 4/2001 | Brzoskowski et al. | |
| 6,401,397 | B2 | 6/2002 | Klein et al. | |
| 6,500,561 | B1 | 12/2002 | Yoshida et al. | |
| 6,571,514 | B1 | 6/2003 | Aritake | |
| 6,617,015 | B2 | 9/2003 | Rood | |
| 6,684,574 | B2 * | 2/2004 | Hayashi | 49/490.1 |
| 6,777,068 | B2 | 8/2004 | Teramoto et al. | |
| 6,786,007 | B2 | 9/2004 | Aritake | |
| 6,922,945 | B2 * | 8/2005 | Dron | 49/477.1 |
| 6,996,936 | B1 | 2/2006 | Maass | |
| 7,196,137 | B2 * | 3/2007 | McBride et al. | 525/97 |
| 7,257,924 | B2 | 8/2007 | Kounobu et al. | |
| 7,319,121 | B2 | 1/2008 | Jacob | |
| 7,368,174 | B2 * | 5/2008 | Fonda | 428/447 |
| 2002/0092242 | A1 | 7/2002 | Hope | |
| 2002/0144466 | A1 * | 10/2002 | Gopalan et al. | 49/475.1 |
| 2003/0150168 | A1 | 8/2003 | Van Den Oord | |
| 2004/0006148 | A1 | 1/2004 | Harris et al. | |
| 2004/0043188 | A1 | 3/2004 | Tsujiguchi | |
| 2004/0062407 | A1 | 4/2004 | Ziegler et al. | |
| 2005/0182193 | A1 | 8/2005 | Ajbani et al. | |

(Continued)

FOREIGN PATENT DOCUMENTS

| | | | |
|---|---|---|---|
| EP | 1 072 380 | B1 | 3/2006 |
| EP | 1 842 711 | A1 | 10/2007 |
| WO | WO 2007106390 | A2 | 9/2007 |

OTHER PUBLICATIONS

Uniprene® UN-1674C data sheet.*

(Continued)

*Primary Examiner* — Katherine Mitchell
*Assistant Examiner* — Catherine A Kelly
(74) *Attorney, Agent, or Firm* — Brian R. Morrison; Westman, Champlin & Kelly, P.A.

(57) ABSTRACT

A weather strip for use with a frame structure having a sharp corner, the weather strip comprising a stem portion and a bulb portion secured to a first end of the stem portion, where the bulb portion has a bulb wall comprising a soft thermoplastic elastomeric material.

13 Claims, 5 Drawing Sheets

U.S. PATENT DOCUMENTS

| | | | |
|---|---|---|---|
| 2007/0218270 | A1 | 9/2007 | Huntress et al. |
| 2007/0237922 | A1 | 10/2007 | Miyakawa et al. |
| 2007/0244234 | A1 | 10/2007 | Adur |
| 2007/0244254 | A1 | 10/2007 | Abraham et al. |
| 2007/0251572 | A1 | 11/2007 | Hoya et al. |

OTHER PUBLICATIONS

Uniprene® UN-2598A data sheet.*
Matweb, Shore (Durometer) Hardness Testing of Plastics, no date available.*
Global Rubber, Material Seletion Guide, no date available.*
Handbook of Polyolefins, Edited by Cornelia Vasile, pp. 876,881, Jan. 2002.*
*Extrusion Processing of SANTOPRENE® Thermoplastic Rubber*, Monsanto pp. 1-12, 1985.
Extrusion Foaming Technology for SANTOPRENE® Thermoplastic Rubber, Revised, Monsanto Technical Paper.
*Foam Extrusion Technology for TP Elastomer*, Plastic Technology, 2 pages, Feb. 1987.

* cited by examiner

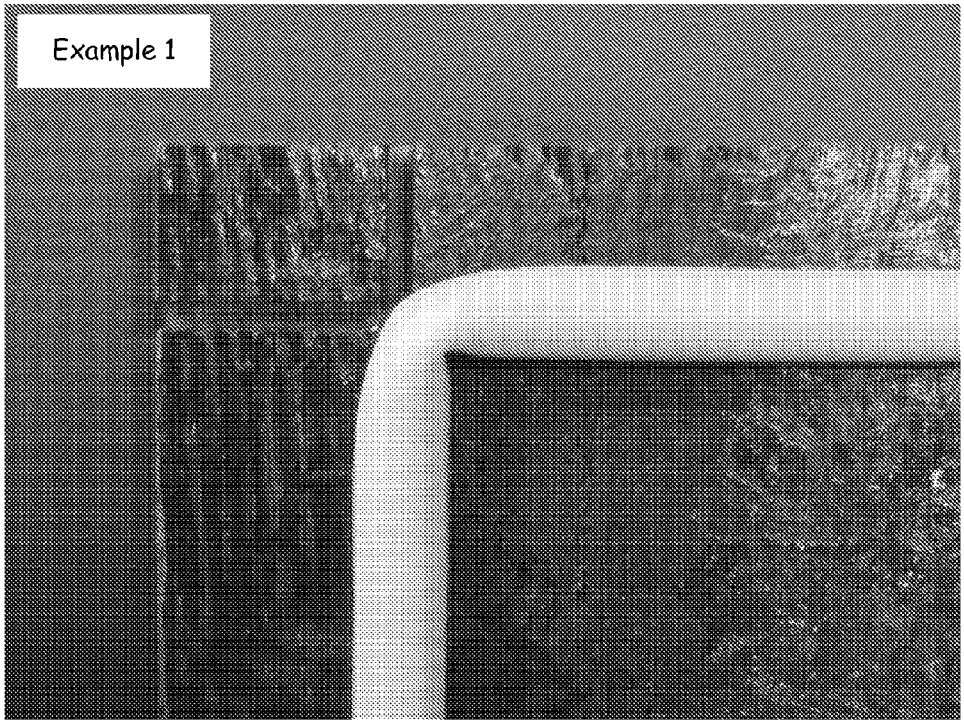
FIG. 5A
FIG. 5B
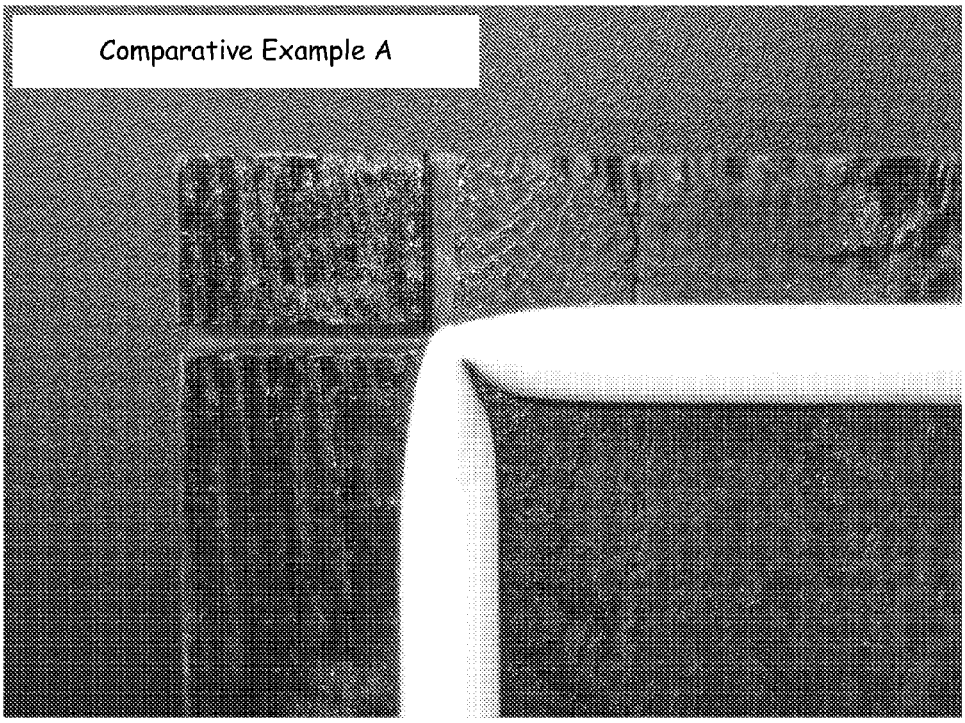

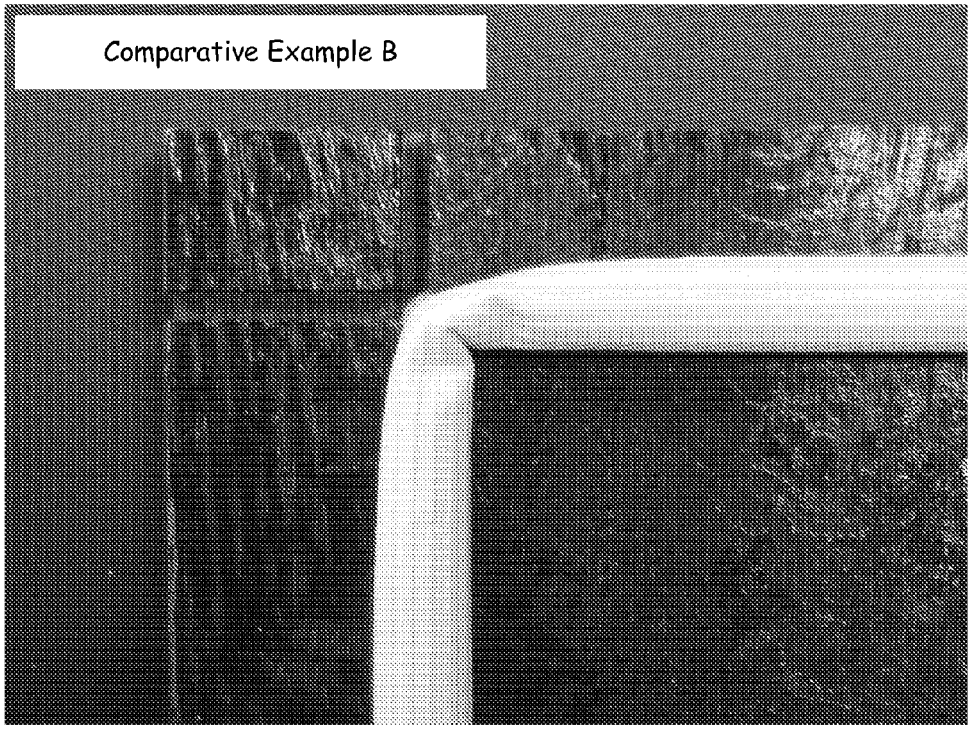
FIG. 5C
FIG. 5D
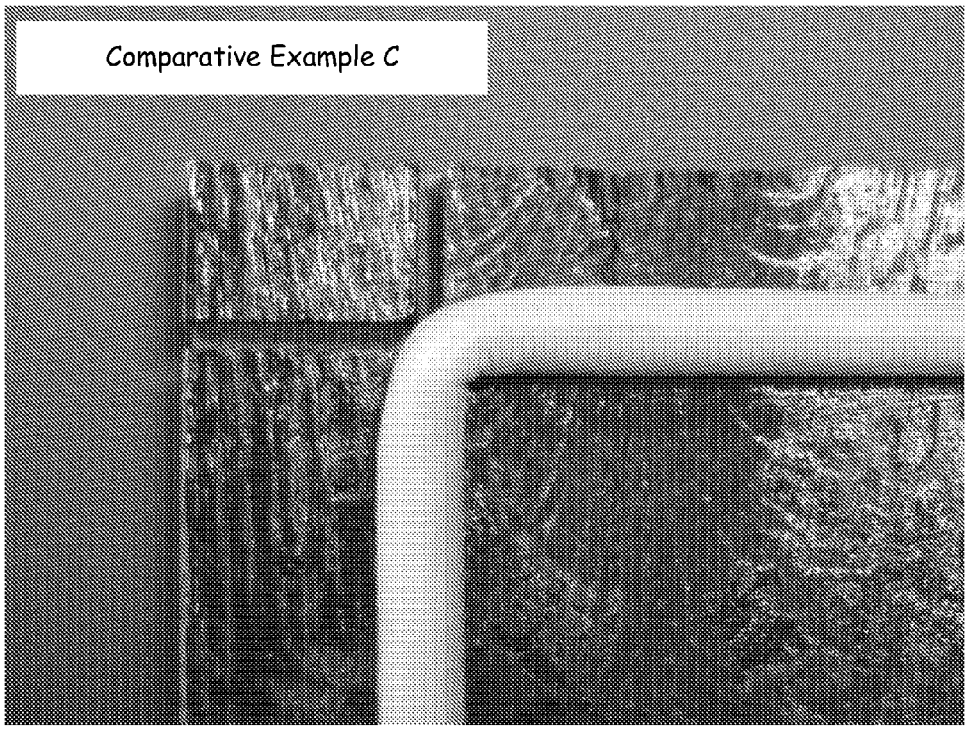

WEATHER STRIP FOR USE WITH FRAME STRUCTURES HAVING SHARP CORNERS

BACKGROUND

The present invention relates to weather strips, and in particular, relates to weather strips having bulb portions fabricated from thermoplastic elastomeric materials.

Weather strips for residential and industrial windows and doors are fabricated in a variety of designs. One popular design includes a bulb sealing portion secured to a stem, where the stem is used to secure the bulb portion to a frame structure of the given window or door. This allows the bulb portion to function as a weather seal during use. The materials typically used for the stems and bulb portions desirably exhibit a variety of physical properties such as weatherability, sealability, ease of installation, low cost, and the like. However, many of the physical properties oppose each other. For example, a common bulb portion material includes ethylene propylene diene monomer (EPDM) rubber, which is a thermosetting material that provide good flexibility and sealability. The flexibility of the EPDM rubber allows the respective bulb portion to be used with frame structures having sharp corners (e.g., 90-degree corners). However, due to their thermosetting nature, EPDM rubbers are difficult to recycle, thereby increasing environmental waste concerns. Furthermore, such materials have limited durabilities to weathering conditions (e.g., in non-black colors), which can reduce the useful lives of the weather strips.

Other conventional weather strips have bulb portions with rigid walls to provide good weather seals. However, when negotiating around sharp corners, such weather strips typically bulge, pucker, and/or wrinkle, thereby reducing their ability to form proper weather seals at the given corners. One common technique for eliminating the bulging, puckering, and/or wrinkling at the sharp corners involves cutting the weather strips into segments at the corners. However, this technique leaves small gaps at the corners, which can allow air and water to flow through. Accordingly, there is an ongoing need for weather strips capable of forming good weather seals around sharp corners.

SUMMARY

An aspect of the disclosure is directed to a weather strip for use with a frame structure having a sharp corner. The weather strip includes a stem portion configured to secure the weather strip to the frame structure, and a bulb portion secured to a first end of the stem portion, where the bulb portion compositionally includes a soft thermoplastic elastomeric material. A continuous segment of the weather strip is configured to be bent for substantial alignment with a sharp corner of a frame structure.

Another aspect of the disclosure is directed to a method for using a weather seal. The method includes providing a frame structure having a first kerf section and a second kerf section that intersect at a sharp corner, and providing a weather strip that includes a stem portion and a bulb portion secured to a first end of the stem portion, where the bulb portion has a bulb wall that compositionally includes a soft thermoplastic elastomeric material. The method also includes bending the weather strip for at least partial alignment with the first kerf section, and inserting the stem portion of the weather strip, being continuous through the bend, into the first kerf section, the second kerf section, and the sharp corner.

A further aspect of the disclosure is directed to a weather strip that includes a stem portion configured to secure the weather strip to a frame structure, and a hollow bulb portion secured to a first end of the stem portion, where the hollow bulb portion compositionally includes a soft thermoplastic elastomeric material. The weather strip also includes a coating disposed on at least a portion of an inner diameter surface of the hollow bulb portion, where the coating compositionally includes a material that exhibits a lower self adhesion relative to a self adhesion exhibited by the soft thermoplastic elastomeric material of the hollow bulb portion.

BRIEF DESCRIPTION OF THE DRAWINGS

FIGS. 5A-5D are photographs of an exemplary weather strip of the present disclosure and comparative example weather strips, where each weather strip is secured to a frame structure at a sharp corner.

DETAILED DESCRIPTION

Figure 1:
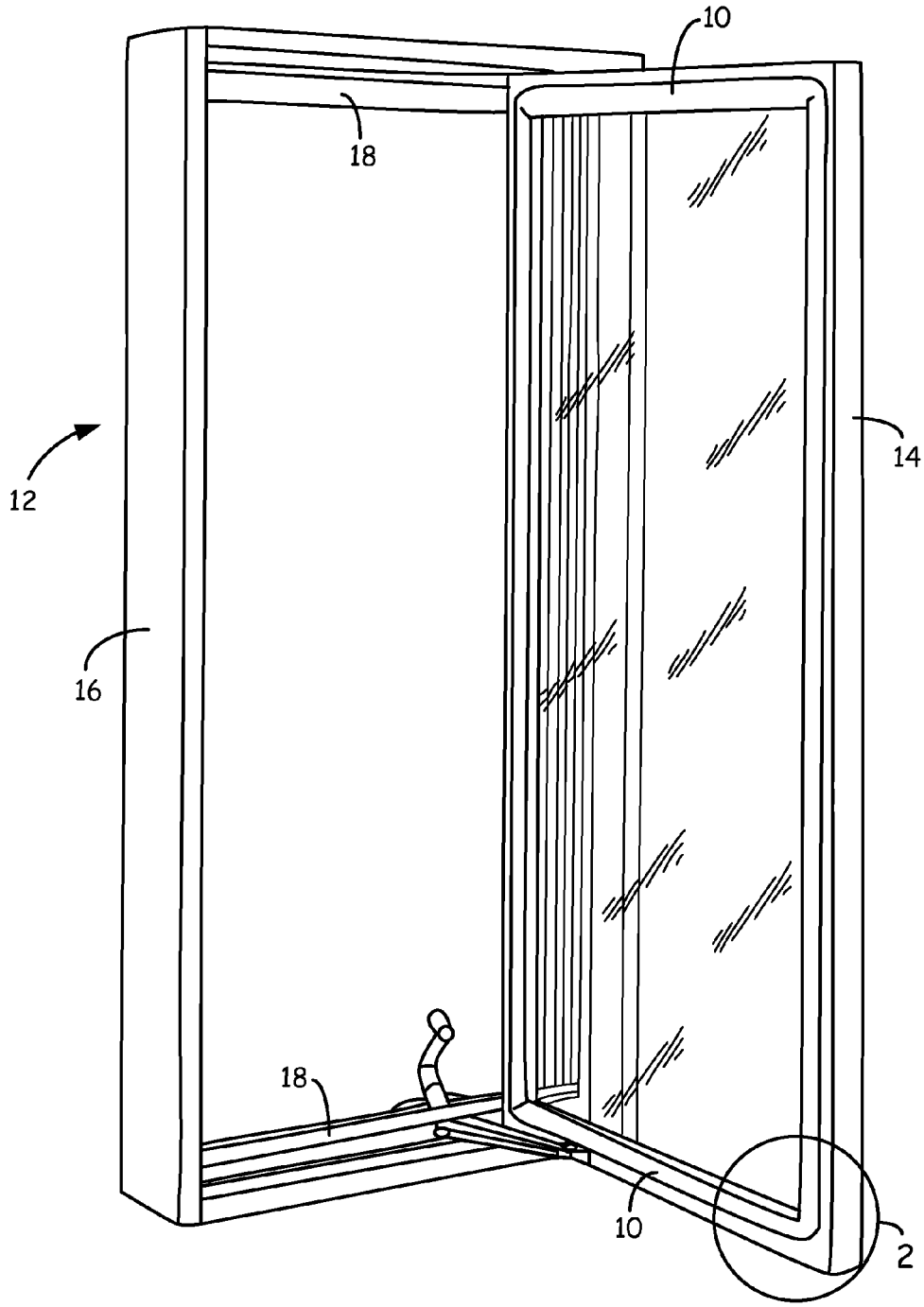
FIG. 1 is a perspective view of a weather strip of the present disclosure secured to a window sash of a casement window.

The present disclosure is directed to weather strip 10, which is shown in use with casement window 12 in FIG. 1. Weather strip 10 is suitable for providing weather seals for a variety of industrial, commercial, and residential assemblies, such as window and doors assemblies (e.g., casement window 12). As discussed below, weather strip 10 is capable of bending around sharp corners with substantially no bulging, puckering, or wrinkling. This allows weather strip 10 to provide good weather sealing at the given corners, thereby preventing the flow of air and water.

In the embodiment shown in FIG. 1, weather strip 10 is secured around the perimeter of window sash 14 of casement window 12, where window sash 14 is pivotally connected to frame member 16 of casement window 12 in a standard manner. The location of weather strip 10 around the perimeter of window sash 14 allows weather strip 10 to provide a weather seal for casement window 10 when window sash 14 is in a closed position against frame member 16. This compressively engages weather strip 10 with the contact perimeter of frame member 16 (shown as perimeter 18 in FIG. 1) along the length of weather strip 10 with substantially no gaps through which air or water may flow, other than at the cut ends of weather strip 10.

In an alternative embodiment, weather strip 10 may be secured to frame member 16 (e.g., at contact perimeter 18), which also allows weather strip 10 to provide a weather seal for casement window 12. Furthermore, while the following discussion of weather strip 10 is made with reference to casement window 12, weather strip 10 may be secured to different frame structures to provide weather seals for a variety of different assemblies, such as window and door assemblies. As used herein, the term "frame structure" refers to a structure that is suitable for retaining a weather strip (e.g., with one or more kerfs).

Weather strip 10 is capable of bending around the corners of window sash 14 with substantially no bulging, puckering, or wrinkling. This is in contrast to conventional weather strips, which typically bulge, pucker, and/or wrinkle around sharp corners. The bulging, puckering, and/or wrinkling typically creates gaps through which air and water may undesirably flow. As discussed above, the typical solution to this problem involves cutting the conventional weather strip at the corners, which, itself, can allow air and water to flow through. However, because weather strip 10 is capable of providing good weather seals around sharp corners, a single, continuous length of weather strip 10 may extend around the entire perimeter of window sash 14 without interruption (with the exception of the cut ends of strip 10). This allows weather strip 10 to provide a continuous weather seal around the entire perimeters of window sash 14 and frame member 16. Accordingly, as used herein, the term "continuous" when used to describe a segment or length of the weather strip (e.g., weather strip 10), such as a "continuous segment" of the weather strip, refers to a non-interrupted length of the weather strip, and precludes segments that are joined through mechanical techniques (e.g., interlocking segments), chemical techniques (e.g., adhesion), thermal techniques (e.g., welding), or with the use of other joining processes.

Figure 2:
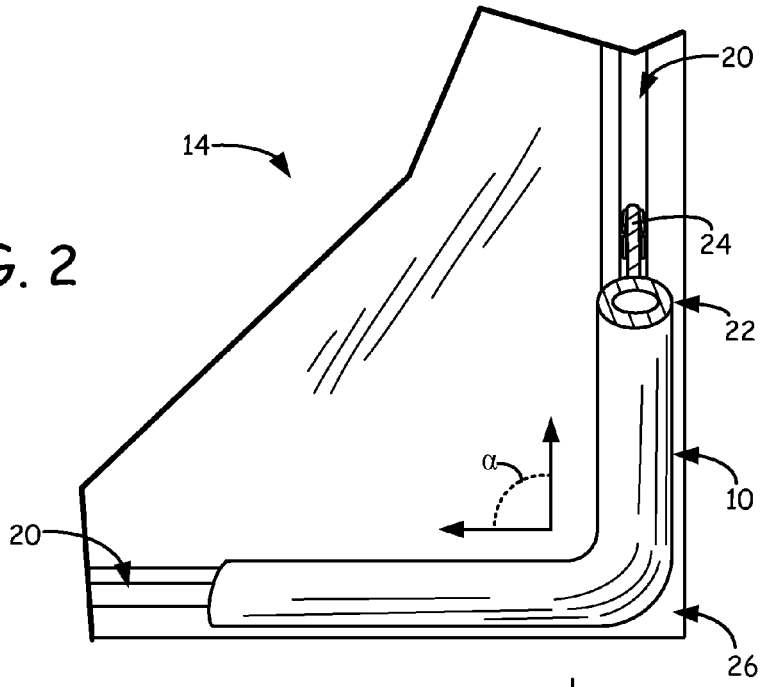
FIG. 2 is an expanded view of section 2 taken in FIG. 1, illustrating the weather strip secured in a kerf of the window sash at a sharp corner.

As shown in FIG. 2, window sash 14 includes kerf 20, which is a slot formed around the perimeter of window sash 14 in a conventional manner. Weather strip 10 includes bulb portion 22 and stem portion 24, where stem portion 24 desirably exhibits a cross-sectional profile that allows it to be readily inserted into kerf 20, and once inserted, functions as an anchor for securing weather strip 10 to window sash 14. During insertion, stem portion 24 may be progressively inserted into kerf 20 along the perimeter of window sash 14, where the particular sequence of insertion may vary. At corner 26 of window sash 14, weather strip 10 may be bent and inserted into kerf 20, thereby providing a continuous weather seal around corner 26.

As discussed above, weather strip 10 is suitable for providing weather seals at sharp corners (e.g., corner 26). As used herein, the term "sharp corner" refers to a corner with angle of about 100 degrees or less. Accordingly, examples of suitable corner angles "a" for use with weather strip 10 range from about 60 degrees to about 100 degrees, with particularly suitable angles $\alpha$ ranging from about 80 degrees to about 95 degrees. As shown in FIG. 2, corner 26 is a sharp corner that exhibits an angle $\alpha$ of about 90 degrees. When used with sharp corners, bulb portion 22, which is the portion of weather strip 10 configured to provide the weather seal, exhibits substantially no bulging, puckering, or wrinkling at the corners. This allows weather strip 10 to maintain good compressive contact between window sash 14 and frame member 16 at the corners (e.g., corner 26), thereby preventing the flow of air and water.

Figure 3:
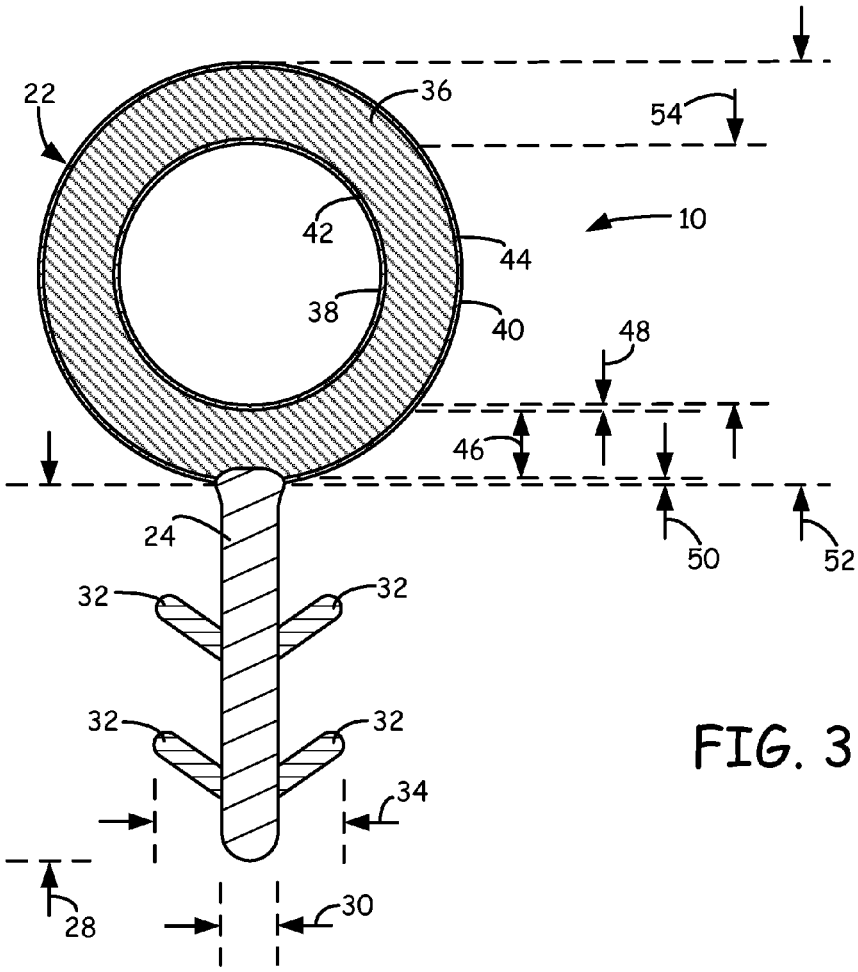
FIG. 3 is a sectional view of the weather strip of the present disclosure.

As shown in FIG. 3, stem portion 24 is secured to, and extends from, bulb portion 22. Stem portion 24 may be derived from a variety of materials, such as thermoplastic polymers (e.g., polyethylenes, polypropylenes, and combinations thereof). Stem portion 24 is desirably more rigid than bulb portion 22. As discussed below, bulb portion 22 is desirably derived from one or more soft materials, which is beneficial for reducing bulging, puckering, and wrinkling at sharp corners. However, stem portion 24 is desirably more rigid to increase the ease of inserting stem portion 24 into a kerf (e.g., kerf 20). The use of soft materials for stem portion 24 may cause undesirable buckling of stem portion 24 when attempting to insert it into the kerf. Additionally, the use of soft materials for stem portion 24 may undesirably allow weather strip 10 to stretch along its longitudinal axis, which can increase time and effort required to insert stem portion 24 into a kerf.

Suitable lengths 28 for stem portion 24 may vary depending on the dimensions of the intended kerf. For a kerf depth of about 0.280 inches, examples of suitable lengths 28 for stem portion 24 range from about 0.150 inches to about 0.280 inches, with particularly suitable lengths 28 ranging from about 0.200 inches to about 0.250 inches, where length 28 is a length measured from the surface intersection of bulb portion 22 and stem portion 24. Suitable average lateral widths 30 for stem portion 24 may also vary depending on the dimensions of the intended kerf. For a kerf width of about 0.080 inches, examples of suitable widths 30 for stem portion 24 range from about 0.020 inches to about 0.070 inches, with particularly suitable widths 30 ranging from about 0.030 inches to about 0.050 inches.

Weather strip 10 also includes a plurality of barbs 32 secured to stem portion 24 for anchoring stem portion 24 within a kerf (e.g., kerf 20). Barbs 32 may also be derived from a variety of materials, and desirably exhibit flexible and/or elastic properties to allow barbs 32 to at least partially collapse when stem portion 24 is inserted into a kerf, and to function as anchors for securing weather seal 10 within the kerf. Suitable materials for barbs 32 include thermoplastic elastomers, ionomers, unsaturated rubbers, saturated rubbers, and combinations thereof. Examples of particularly suitable materials for barbs 32 include thermoplastic elastomers, such as thermoplastic vulcanizates, block copolymers (e.g., styrene-ethylbutylene-styrene copolymers), polyolefin blends, elastomeric alloys, thermoplastic polyurethanes, thermoplastic copolyesters, thermoplastic polyamides, and combinations thereof.

Suitable average lateral widths 34 for stem portion 24 and barbs 32 may also vary depending on the dimensions of the intended kerf. For a kerf width of about 0.080 inches, examples of suitable widths 34 for stem portion 24/barbs 32 range from about 0.090 inches to about 0.150 inches, with particularly suitable widths 34 ranging from about 0.100 inches to about 0.120 inches, where width 34 is measured with barbs 32 in relaxed states. The above-discussed suitable dimensions for length 28 and widths 30 and 34 allow stem portion 24 to be readily inserted within a kerf having standard dimensions, and to further allow barbs 32 to function as anchors for securing weather strip 10 within the kerf. In alternative embodiments, barbs 32 may exhibit different geometric configurations for functioning as anchors for weather strip 10. Examples of suitable geometric configurations for barbs 32 include those disclosed in Peterson et al., U.S. Application Publication No. 2006/0059820. In an additional alternative embodiment, stem 24 and barbs 32 may be omitted, and bulb portion 22 may be secured to a frame structure (e.g., window sash 14) with an adhesive stem portion.

Bulb portion 22 is the portion of weather strip 10 that provides the weather seal when weather strip 10 is compressed between window sash 14 and frame member 16. In the embodiment shown in FIG. 3, bulb portion 22 includes bulb wall 36 disposed between inner coating 38 and outer coating 40, where inner coating 38 is secured to inner diameter (ID) surface 42 of bulb wall 36, and outer coating 40 is secured to outer diameter (OD) surface 44 of bulb wall 36. Bulb wall 36 may be derived from a variety of soft materials, thereby allowing bulb portion 22 bend around sharp corners (e.g., corner 26) substantially without bulging, puckering, or wrinkling.

Suitable materials for bulb wall 36 include thermoplastic elastomers, such as thermoplastic vulcanizates, low-durometer block copolymers, and combinations thereof. Examples of suitable thermoplastic vulcanizates for bulb wall 36 include alloys commercially available under the trademarks "SANTOPRENE" from ExxonMobil Chemical Company, Houston, Tex.; and "UNIPRENE" from Teknor Apex Company, Pawtucket, R.I. Examples of suitable low-durometer block copolymers for bulb wall 36 include styrene-based block copolymers, such as styrene-ethylbutylene-styrene (SEBS) copolymers commercially available from Starflex Corporation, Jonesboro, Ga.; and from Kraton Polymers, LLC, Houston, Tex. Additional examples of suitable thermoplastic elastomers include styrenic polyolefin thermoplastic elastomers commercially available under the trade designations "INVISION"GX5030G5 & GX5030G3U Elastomers from A. Shulman, Inc., Akron, Ohio. Suitable SEBS copolymers may also be treated with one or more oils for durometer reduction.

Suitable durometers for the material of bulb wall 36 include Shore A hardnesses of about 30 or less, with particularly suitable durometers including Shore A hardnesses of about 20 or less, and with even more particularly suitable durometers including Shore A hardnesses of about 15 or less. As used herein, "Shore A hardness" refers to a Shore A hardness measured pursuant to ASTM D2240-00. The soft nature of bulb wall 36 also allows bulb wall 36 to have a wall thickness 46 that is thick enough to reduce the risk of tearing during handling and use, while also allowing bulb portion 22 to bend around sharp corners substantially without bulging, puckering, or wrinkling. Examples of suitable average wall thickness 46 for bulb wall 36 range from about 0.030 inches to about 0.080 inches, with particularly suitable average wall thicknesses 42 ranging from about 0.040 inches to about 0.060 inches, where wall thickness 46 is measured between ID surface 42 and OD surface 44.

Inner coating 38 is a coating that extends over at least a portion of ID surface 42 of bulb wall 36, and more desirably extends over the entire surface area of ID surface 42. Correspondingly, outer coating 40 is a coating that extends over at least a portion of OD surface 44 of bulb wall 36, and more desirably extends over the entire surface area of OD surface 44. Inner coating 38 and outer coating 40 are each desirably derived from one or more materials having low coefficients of friction, and low adhesive and tackiness properties (e.g., low self adhesion), such as low-surface energy thermoplastic elastomers, ionomers, unsaturated rubbers, saturated rubbers, powders, and combinations thereof. Examples of particularly suitable materials for each of inner coating 38 and outer coating 40 include low-surface energy thermoplastic elastomers, such as thermoplastic vulcanizates, fluorinated thermoplastic elastomers, block copolymers, polyolefin blends, elastomeric alloys, thermoplastic polyurethanes, thermoplastic copolyesters, thermoplastic polyamides, and combinations thereof. Examples of suitable thermoplastic vulcanizates for each of inner coating 38 and outer coating 40 include alloys commercially available under the trademark "SANTOPRENE" from ExxonMobil Chemical Company, Houston, Tex. Suitable powders for use to form one or both of inner coating 38 and outer coating 40 include a variety of different particulates configured to reduce friction, adhesion, and/or tackiness, such as talc (e.g., talcum powder), mica, calcium carbonate, fluorinated-polymer particles, and combinations thereof.

The materials of inner coating 38 and outer coating 40 desirably exhibit lower self-adhesion properties relative to self adhesion properties exhibited by the material of bulb wall 36. For example, suitable coefficients of friction for the materials of inner coating 38 and outer coating 40 include coefficients of friction of about 0.50 or less, with particularly suitable coefficients of friction for the materials of inner coating 38 and outer coating 40 including coefficients of friction of about 0.40 or less. The low self adhesion of inner coating 38 allows bulb portion 22 reduces the amount that the inner region of bulb portion 22 sticks together when compressed (e.g., between window sash 14 and frame member 16), thereby allowing bulb portion 22 to readily expand after being compressed. Accordingly, weather strip 10 exhibits a high level of recovery after being compressed. The low surface energy of outer coating 40 reduces the amount that bulb portion 22 sticks to objects (e.g., window sash 14 and frame member 16), and provides a smooth, aesthetically pleasing feel for handling. The low surface energies of inner coating 38 and outer coating 40 also reduce the adherence of dirt and other contaminants.

Suitable coating thicknesses for each of inner coating 38 and outer coating 40 (referred to as coating thicknesses 48 and 50, respectively) may vary depending on the materials used for inner coating 38 and outer coating 40, and on the durometers of inner coating 38 and outer coating 40. Examples of suitable average coating thicknesses for each of inner coating 38 and outer coating 40 range from about 0.00025 inches to about 0.015 inches, with particularly suitable average coating thicknesses for each of inner coating 38 and outer coating 40 range from about 0.0005 inches to about 0.010 inches.

Due to the low coating thicknesses, the materials of one or both of inner coating 38 and outer coating 40 may exhibit high durometers relative to the material of bulb wall 36 without substantially affecting the ability of bulb portion 22 to bend around sharp corners substantially without bulging, puckering, or wrinkling. Examples of suitable durometers for the materials of inner coating 38 and outer coating 40 include Shore D hardnesses of about 75 or less, with particularly suitable durometers including Shore D hardnesses of about 50 or less. As used herein, "Shore D hardness" refers to a Shore D hardness measured pursuant to ASTM D2240-00. In alternative embodiments, may one or both of inner coating 38 and outer coating 40 may be omitted from bulb portion 22, thereby exposing bulb wall 36 at ID surface 42 and/or OD surface 44.

Bulb portion 22 also includes outer diameter 52 and inner diameter 54, where outer diameter 52 is an average outer diameter that is the bulb portion 22. Inner diameter 54 is the average diameter of the hollow region between opposing surfaces of inner coating 38. Suitable ratios of outer diameter 52 to inner diameter 54 (i.e., OD/ID ratio) may vary depending on the geometry of bulb portion 22. Examples of suitable average ratios of outer diameter 52 to inner diameter 54 range from about 1.0 to 3.0, with particularly suitable average ratios ranging from about 1.2 to about 2.5, and with even more particularly suitable average ratios ranging from about 1.5 to about 2.0. While bulb portion 22 is described as having a hollow region, in alternative embodiments, bulb portion 22 may be filled with a low-durometer material (e.g., a low-durometer, foam thermoplastic elastomer), thereby providing a non-hollow bulb portion.

In one embodiment, stem portion 24, barbs 32, bulb wall 36, inner coating 38, and outer coating 40 are each desirably derived from one or more thermoplastic materials. The use of thermoplastic materials increases the recyclability of weather strip 10, thereby providing an environmentally friendly product. In comparison, thermosetting materials, such as ethylene propylene diene monomer (EPDM) rubbers, are difficult to recycle, which can increase environmental waste concerns. Furthermore, the above-discussed suitable materials for stem portion 24, barbs 32, bulb wall 36, inner coating 38, and outer coating 40 desirably exhibit good stability to weathering conditions (e.g., heat, humidity, and ultraviolet radiation). This allows weather strip 10 to provide good weather sealing over extended periods of use.

The materials of stem portion 24, barbs 32, bulb wall 36, inner coating 38, and/or outer coating 40 may also include one or more additional additives, such as fillers, pigments, dyes, rheology modifiers, antioxidants, stabilizing agents, processing aids, neutralizers, and combinations thereof. Suitable concentrations of the additional additives in the materials of stem portion 24, barbs 32, bulb wall 36, inner coating 38, and/or outer coating 40 range from about 0.1% by weight to about 20% by weight, with particularly suitable concentrations ranging from about 1% by weight to about 5% by weight. With respect to pigments and dyes, the use of thermoplastic materials, such as thermoplastic vulcanizates, increases the ability of attaining the desired colors for weather strip 10. In comparison, weather strips derived from EPDM rubbers are difficult to color. EPDM rubbers are known to discolor (e.g., exhibit dark tints) when exposed to even small amounts of contaminants during manufacturing.

Weather strip 10 may be manufactured using a variety of processes. For example, one or more of stem portion 24, barbs 32, bulb wall 36, inner coating 38, and outer coating 40 may be coextruded with an extrusion system. Suitable extrusion systems include single-screw extruders having length/diameter (L/D) ratios ranging from about 24:1 to about 48:1, using standard extrusion temperatures for each material (e.g., from about 150° C. to about 250° C.). Weather strip 10 may be coextruded in various lengths, and supplied on spools. During installation, weather strip 10 may be cut to a desired length and stem portion 24 may be pressed into a kerf around the perimeter of frame structure (e.g., into kerf 20 of window sash 14).

As discussed above, because weather strip 10 is capable of bending around sharp corners substantially without bulging, puckering, or wrinkling, the length of weather strip 10 may continue around each sharp corner of the frame structure, rather than requiring separate strips along each section. This preserves the weather seal around the frame structure, thereby preventing the flow of air and water.

The extent of bulging, puckering, and/or wrinkling of a weather strip at a sharp corner correlates to the compression force required to compress the weather strip at the corner. For example, as discussed above, weather seals that have bulb portions derived from hard materials will bulge, pucker, and/or wrinkle when bent at a sharp corner. In particular, the bending causes the bulb portion to pucker at the inner radius edge to create a pinch point, which correspondingly causes the bulb portion to bulge away from the frame structure. The bulged, puckered portion increases the compression force required to compress the given bulb portion at the sharp corner. Thus, during use in a window or door assembly, which is typically designed to compress a standard weather strip by about 25% of its original height (i.e., to about 75% of its original height), the compression force may not be great enough to fully compress the bulged, puckered portion of the weather strip at the sharp corner. This would undesirably allow air and water to flow through the corner of the weather seal.

Weather strip 10, however, is capable of exhibiting low compression forces while bent at sharp corners. Examples of suitable compression forces for weather strip 10 include peak compression forces of about 3.0 newtons (0.67 pounds-force) or less, with particularly suitable peak compression forces of about 2.5 newtons (0.56 pounds-force) or less, and with even more particularly suitable peak compression forces of about 2.0 newtons (0.45 pounds-force) or less. As used herein, the term "peak compression force" refers to a compression force measured at a 25% compression from an original height of the weather strip (i.e., 75% of its original height) in a non-compressed and non-bent state, with a compression rate of 1.3 centimeters/minute (0.5 inches/minute). As used herein, the term "peak compression force" is based on a weather strip segment having segments extending in each direction from the corner, where each segment is about 1.3 centimeters (about 0.5-inches) in length (i.e., about a 2.5 centimeter (1.0-inch) continuous length total). These suitable and particularly suitable peak compression forces allow weather strip 10 to provide good corner weather seals for a variety of different window and door assemblies.

Figure 4:
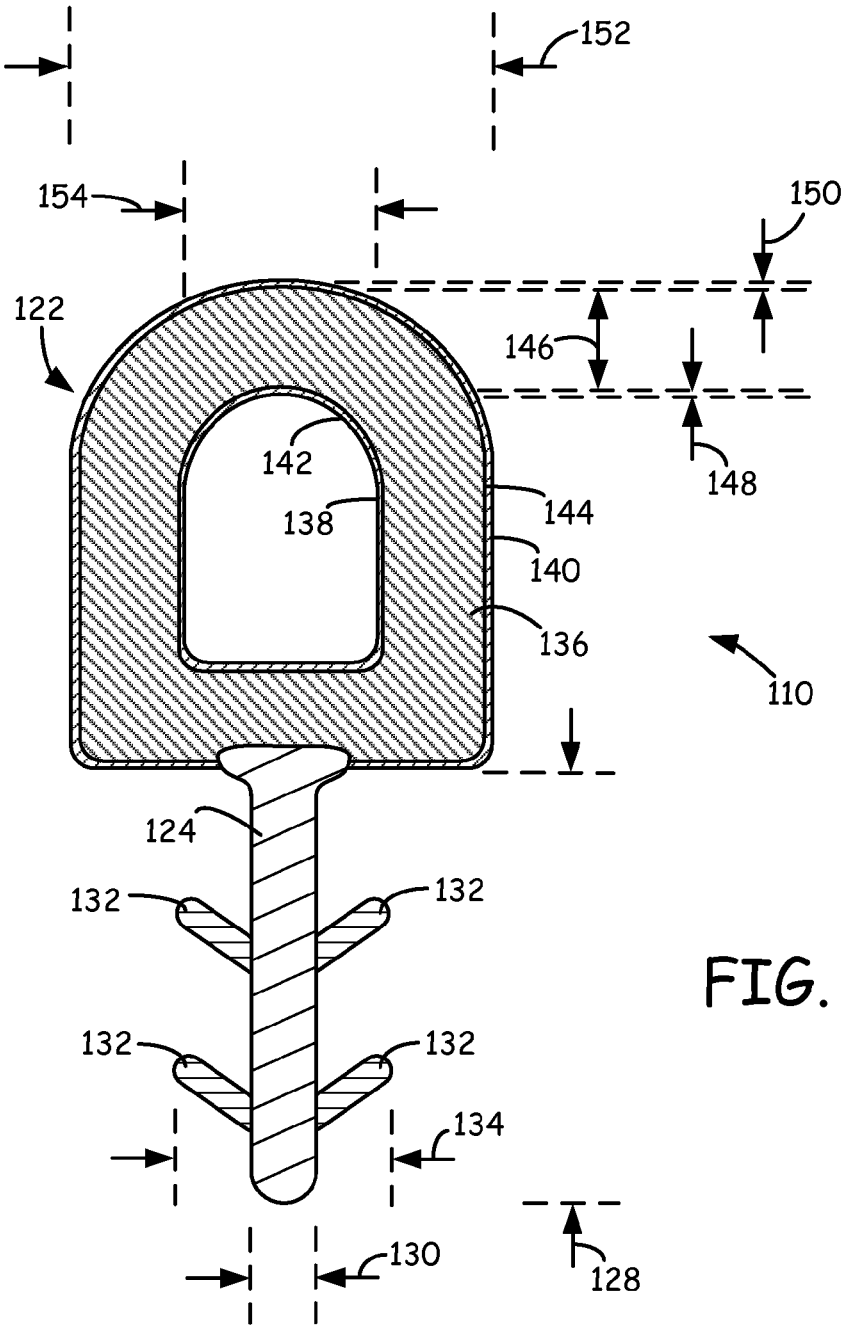
FIG. 4 is a sectional view of an alternative weather strip of the present disclosure.

While weather strip 10 is illustrated with an annular bulb portion (i.e., bulb portion 22), weather strips of the present disclosure may alternatively include a variety of different geometric designs. For example, FIG. 4 shows weather strip 110, which is similar to weather strip 10 and the respective reference labels are increased by "100". Bulb-portion 122 of weather strip 110 has a flat base and rounded top, which is also suitable for providing a weather seal. Suitable dimensions, materials, and properties for the components of weather strip 110 include those discussed above for weather strip 10. Accordingly, weather strip 110 may also bend around sharp corners substantially without bulging, puckering, or wrinkling, thereby providing good weather sealing at the given corners.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Weather strips of Example 1 and Comparative Examples A-C were subjected to multiple tests to compare the suitability of each weather strip for functioning as weather seals. The weather strip of Example 1 included a weather strip of the present disclosure having an annular bulb portion similar to that of weather strip 10 (shown in FIGS. 1-3). The bulb wall of the bulb portion was derived from a blend of a thermoplastic vulcanizate alloy commercially available under the trademark "UNIPRENE" from Teknor Apex Company, Pawtucket, R.I., and a styrene-ethylbutylene-styrene block copolymer, where the blend exhibited a Shore A hardness of about 12, as measured pursuant to ASTM D2240-00. The bulb wall had a wall thickness of about 0.135 centimeters (about 0.053 inches).

The bulb portion also included an inner coating and an outer coating, each derived from a thermoplastic vulcanizate alloy commercially available under the trademark "SANTOPRENE" from ExxonMobil Chemical Company, Houston, Tex., which exhibited a Shore D hardness of about 50, as measured pursuant to ASTM D2240-00. The inner coating and outer coating each had a coating thickness of about 0.002 centimeters (about 0.001 inches), such that the combined wall thicknesses of the bulb wall, the inner coating, and the outer coating was about 0.140 centimeters (about 0.055 inches). The stem portion was formed from a filled polypropylene, and the barbs were formed from styrene-ethylbutylene-styrene block copolymers. The components of the weather strip of Example 1 were co-extruded with a standard single-screw extrusion system.

The weather strip of Comparative Example A was available under the designation TPV Bulb 50135 from Intek Plastics, Hastings, Minn. The weather strip included a hollow bulb portion formed from a thermoplastic vulcanizate alloy commercially available under the trademark "SANTOPRENE" grade 201-64 from ExxonMobil Chemical Company, Houston, Tex., which exhibited a Shore A hardness of 64, as measured pursuant to ASTM D2240-00. The stem portion was formed from rigid polypropylene.

The weather strip of Comparative Example B was available under the trademark "FOAM-TITE" 12403 weather seal from Amesbury Group, Inc., Amesbury, Mass. The weather strip included a filled bulb portion formed from a thermoplastic elastomer foam, which was encased within a wall of a thermoplastic vulcanizate material, where the wall exhibited a Shore A hardness greater than 60, as measured pursuant to ASTM D2240-00. The stem portion was formed from rigid polypropylene.

The weather strip of Comparative Example C was commercially available from Derby Cellular Products, Derby, Conn. The weather strip included a hollow bulb portion formed from cellular EPDM, and the stem portion was formed from non-cellular EPDM.

I. Corner Compression Load Deflection Testing

The weather strips of Example 1 and Comparative Examples A-C were qualitatively and quantitatively measured to determine whether the given strips were capable of bending around sharp corners substantially without bulging, puckering, and/or wrinkling. A one-inch length sample of each weather strip was bent at a mid-point, and the stem portion of each weather strip was inserted into a kerf at a 90-degree angle sharp corner of a wood frame structure. FIGS. 5A-5D respectively show the bent weather strips of Example 1 and Comparative Examples A-C. As shown in FIGS. 5A and 5D, the weather strips of Example 1 and Comparative Example C bent around the sharp corner substantially without bulging or puckering. This was due to the soft materials of the bulb portions of the weather strips of Example 1 (i.e., a low-durometer, thermoplastic elastomeric alloy) and Comparative Example C (i.e., EPDM rubber). The weather strip of Comparative Example C exhibited minor amounts of wrinkling at the inner corner edge.

As shown in FIG. 5B, the weather strip of Comparative Example A exhibited a high level of bulging and puckering. In particular, the corner of the weather strip of Comparative Example A puckered inward at the inner corner edge, thereby causing the weather strip to bulge away from the frame structure at the pinch point. Similarly, as shown in FIG. 5C, the weather strip of Comparative Example B exhibited a high level of bulging, puckering, and wrinkling. In particular, the corner of the weather strip of Comparative Example A puckered inward and wrinkled at the inner corner edge, causing the weather strip to bulge away from the frame structure at the pinch point. As shown in FIGS. 5A-5D, the extent of the bulging and puckering of the weather strips of Comparative Examples A and B were substantially greater than that attained by the weather strips of Example 1 and Comparative Example C.

The weather strip samples of Example 1 and Comparative Examples A-C were then compressed by 25% of their original heights relative to the frame structures (i.e., compressed to 75% of their original heights). This involved measuring the original height of each weather strip secured to the frame structure with a digital caliper, and compressing the given weather strip by 25% of the original height at a constant rate of 1.3 centimeters/minute (0.5 inches/minute). This 25% compression is a typical compression attained during use in residential window and door assemblies, and provides a good assessment for how the weather strips will function during use. The peak compression force required to attain the 25% compression at the sharp corner was then measured at 25° C. for each weather strip. Table 1 shows the measured peak compression forces for the weather strips of Example 1 and Comparative Examples A-C (newtons and pounds-force).

TABLE 1

| Example | Peak compression force (newtons) | Peak compression force (pounds-force) |
|---|---|---|
| Example 1 | 1.73 | 0.39 |
| Comparative Example A | 3.96 | 0.89 |
| Comparative Example B | 8.01 | 1.80 |
| Comparative Example C | 2.09 | 0.47 |

As shown in Table 1, the weather strips of Example 1 and Comparative Example C exhibited substantially lower peak compression forces compared to the weather strips of Comparative Examples A and B. This is due to the softer materials used for the bulb portions of the weather strips of Example 1 and Comparative Example C, and corresponds to the relative corner bend capabilities shown in FIGS. 5A-5D. The bulb portions of the weather strips of Comparative Examples B and C were more rigid, thereby causing substantial amounts of bulging, puckering, and/or wrinkling at the corners. The bulging, puckering, and wrinkling at the corners correspondingly increased the force required to compress the weather strips at the corners. During use in a window or door assembly, the increased compression force required to compress the given weather strips at the corners would result in gaps at the corners that would allow air and water to flow through.

In contrast, the weather strips of Example 1 and Comparative Example C were highly compressible at the corners, thereby forming good weather seals at the corners to prevent the flow of air and water. Furthermore, as discussed above, the weather strip of Example 1 is derived from thermoplastic elastomer materials, thereby providing an environmentally friendly product. In comparison, the EPDM rubber of the weather strip of Comparative Example C is a thermosetting material, which is difficult to recycle, and can increase environmental waste concerns.

II. Compression Set Testing

The weather strips of Example 1 and Comparative Examples A-C were quantitatively measured for post-compression recovery to determine how much of the original height each weather strip was able to recover after being subjected to compressive forces. Nine one-inch length samples of each weather strip were installed into a fixture, and the original height of each sample was then measured using a digital caliper. For each weather strip, three samples were compressed by 25% of the original height in the same manner as discussed above for the Corner Compression Load Deflection Testing, three samples were compressed by 50% of the original height, and three samples were compressed by 75% of the original height (i.e., to 25% of the original height). The compressed samples were then placed in a convection oven maintained at 70° C. (158° F.) for 22 hours. After the 22-hour period, the samples were removed from the convection oven and the compression was removed. Thirty minutes after the compression was removed, the height of each sample was measured using a digital caliper to determine the amount of the original height that the sample recovered to. This measurement was then repeated after 22 hours from the removal of the compression. Table 2 shows the average amount of recovery for each weather strip after the 30-minute period, and Table 3 shows the average amount of recovery for each weather strip after the 22-hour period, where the average amount of recovery is based on the average of the three samples.

TABLE 2

| Example | 25% Compression | 50% Compression | 75% Compression |
|---|---|---|---|
| Example 1 | 63% | 65% | 81% |
| Comparative Example A | 35% | 39% | 63% |
| Comparative Example B | 42% | 49% | 52% |
| Comparative Example C | 69% | 49% | 25% |

TABLE 3

| Example | 25% Compression | 50% Compression | 75% Compression |
|---|---|---|---|
| Example 1 | 63% | 65% | 81% |
| Comparative Example A | 56% | 43% | 63% |
| Comparative Example B | 42% | 50% | 52% |
| Comparative Example C | 71% | 61% | 30% |

As shown in Tables 2 and 3, the weather strip of Example 1 exhibited substantially greater amounts of recovery compared to the weather strips of Comparative Examples A and B for all three compression amounts. Furthermore, the weather strips of Example 1 and Comparative Examples A and B exhibited greater amounts of recovery after being compressed by 75% (i.e., to 25% of the original heights) compared to the 25% and 50% compressions. In contrast, the weather strip of Comparative Example C exhibited substantially lower recoveries after being compressed by 75% compared to the 25% and 50% compressions. Accordingly, the weather strips of the present disclosure exhibit good recoveries over a wide range of compressions. This allows the weather strips of the present disclosure to be used in a variety of different residential, commercial, and industrial applications.

III. Aging Compression Load Deflection Testing

The weather strips of Example 1 and Comparative Examples A-C were also quantitatively measured for compression load deflection after undergoing a heat aging process to determine the stability of the materials of the weather strips. Three one-inch length samples of each weather strip were installed into a fixture, and the original height of each sample was then measured using a digital caliper. In this test, the samples were not bent at a sharp corner. For each weather strip, the three samples were then compressed by 25% of the original height in the same manner as discussed above for the Corner Compression Load Deflection Testing. The peak force required to attain the 25% compression was then measured at 25° C. for each weather strip. The compression was then held for 30 seconds to allow the samples to conform to the compression, and the force was measured again at 25° C. for each weather strip. These initial measurements provided a baseline for measuring the forces measured after aging.

The compressive forces were then removed from the samples, and the samples were heat aged in a convection oven maintained at 70° C. (158° F.) for 120 hours. After the 120-hour period, the samples were removed from the convection oven, and allowed to cool to 25° C. The peak force required to attain the 25% compression was then measured at 25° C. for each aged weather strip. The compression was then held for 30 seconds to allow the aged samples to conform to the compression, and the force was measured again at 25° C. for each aged weather strip. Table 4 shows the measured force results for the initial weather strips, and Table 5 shows the measured force results for the heat aged weather strips (in newtons and pounds-force), where the forces are based on the average of the three samples.

TABLE 4

| Example | Peak force (Initial) (newtons) | Peak force (Initial) (pounds-force) | 30-second force (Initial) (newtons) | 30-second force (Initial) (pounds-force) |
|---|---|---|---|---|
| Example 1 | 1.73 | 0.39 | 1.38 | 0.31 |
| Comparative Example A | 0.85 | 0.19 | 0.49 | 0.11 |
| Comparative Example B | 2.00 | 0.45 | 1.42 | 0.32 |
| Comparative Example C | 3.20 | 0.72 | 2.62 | 0.59 |

TABLE 5

| Example | Peak force (Aged) (newtons) | Peak force (Aged) (pounds-force) | 30-second force (Aged) (newtons) | 30-second force (Aged) (pounds-force) |
|---|---|---|---|---|
| Example 1 | 1.73 | 0.39 | 1.33 | 0.30 |
| Comparative Example A | 1.20 | 0.27 | 0.89 | 0.20 |
| Comparative Example B | 1.78 | 0.40 | 1.42 | 0.32 |
| Comparative Example C | 3.34 | 0.75 | 2.98 | 0.67 |

As shown in Tables 4 and 5, the measure force results for the weather strip of Example 1 were substantially the same for the initial and heat aged samples. Thus, the weather strip of Example 1 exhibited good stability against the heat aging conditions. In comparison, the weather strip of Comparative Example A exhibited a substantial increase in the measure force results, and the weather strip of Comparative Example C exhibited a mild increase in the measure force results, where these increases in the measured force results were due to degradations of the weather strips from the heat aging conditions.

IV. Water Seal Testing

The weather strips of Example 1 and Comparative Examples A-C were also qualitatively measured to determine whether the weather strips were capable of providing good seals against water. Each weather strip was inserted into a 0.080-inch kerf of a vertically-positioned wood frame having two 90-degree corners. This formed a U-shape seal around the bottom and lateral sides of the frame. A Plexiglas plate was then pressed onto the weather strip and secured to the frame, which compressed the weather strip by about 25% of its original height (i.e., to about 75% of its original height). Water was then poured into the gap between the wood frame and the Plexiglas plate to a height of 1.5 inches. This water column represented a Design Pressure (DP) of 50 pounds/square-foot (i.e., a DP-50 rated unit), which is a desired standard for use in coastal environments.

The tests for the weather strips of Example 1 and Comparative Example C did not leak any water along the lateral and bottom walls, or at the corners. In contrast, the tests for the weather strips of Comparative Examples A and B exhibited leaks at each of the corners. The corner leaks for the weather strips of Comparative Examples A and B occurred due to the substantial bulging, puckering, and wrinkling that occurred that corners. Accordingly, the substantial lack of bulging, puckering, and wrinkling for the weather strips of Example 1 and Comparative Example C allowed the given weather strips to provide good seals for the wood frame/Plexiglass assembly, including the locations of the sharp corners.

V. Insertion Force Testing

The insertion forces for the weather strips of Example 1 and Comparative Examples A-C were also quantitatively measured to identify the amount of effort required to install the weather strips to frame structures. The weather strips of Example 1 and Comparative Examples A and B were inserted into a kerf having a width of 0.080 inches, and the weather strip of Comparative Example C was inserted into a kerf having a width of 0.100 due to its design for this larger kerf size. The force required to insert each of the weather strips was measured using a digital force gauge commercially available under the trademark "CHATILLON" DFIS 10 Digital Force Gauge from Ametek, Inc., Paoli, Pa. The force was measured while inserting a one-inch length sample of each weather strip into the respective kerf at a rate of two inches per minute. Three samples of each weather strip were measured. Table 6 shows the measured insertion forces for the weather strips of Example 1 and Comparative Examples A-C (in Newtons/meter and pounds-force/inch).

TABLE 6

| Example | Insertion Force (newtons) | Insertion force (pounds-force) |
|---|---|---|
| Example 1 | 3.16 | 0.71 |
| Comparative Example A | 5.20 | 1.17 |
| Comparative Example B | 11.65 | 2.62 |
| Comparative Example C | 16.15 | 3.63 |

As shown in Table 6, the weather strip of Example 1 required substantially less insertion force compared to the weather strips of Comparative Examples A-C. This is believed to be due to the combination of the soft bulb portion and the more rigid stem portion. Thus, in addition to providing good weather sealing, the weather strips of the present disclosure are also easy to install. In comparison, the weather strip of Comparative Example C was difficult to install, even in the larger kerf width, due to lack of rigidity of the stem portion.

VI. Friction Testing

The coefficient of friction for the weather strips of Example 1 and Comparative Examples A-C were measured to compare the surface tackinesses of the respective weather strips. Samples of the weather strips were inserted into a kerf under a 0.66-kilogram block. The friction force of each sample was measured with a material tester commercially available under from Kayeness, Inc., Honey Brook, Pa. equipped with a force gauge commercially available under the trademark "CHATILLON" Force Gauge from Ametek, Inc., Paoli, Pa., where the material tester moved at a rate of six inches (15.2 centimeters) per minute. The coefficient of friction was then calculated as the measured friction force/normal force, where the normal force was the weight of the block (i.e., 0.66-kilograms). Table 7 shows the resulting coefficients of friction for the weather strips of Example 1 and Comparative Examples A-C.

TABLE 7

| Example | Coefficient of friction |
|---|---|
| Example 1 | 0.420 |
| Comparative Example A | 0.409 |
| Comparative Example B | 0.106 |
| Comparative Example C | 0.944 |

As shown in Table 7, the weather strip of Example 1 exhibited a substantially lower coefficient of friction compared to the weather strip of Comparative Example C. Thus, the weather strip of Example 1 exhibits good sliding mechanics relative to the weather strip of Comparative Example C. This is beneficial for reducing wear and damage on the weather strip of Example 1 over extended periods of use.

VII. Product Stretch Testing

The weather strips of Example 1 and Comparative Examples A-C were also quantitatively measured for stretchability. Each weather strip was cut into a 112-centimeter (44-inch) segment. A first end of the segment was clamped with a hand clamp, which compressed the first 5.1 centimeters (two inches) of the segment. The segment was then stretched out and the second end was attached at the 102-centimeter (40-inch) point to a force gauge commercially available under the tradename "SERIES EG" Force Gauge from Mark-10 Corporation, Copiague, N.Y. A 0.49-Newton (0.1-pound) force was used to pull the segment tight and straight prior to taking measurements. The 102-centimeter (40-inch) point along the segment was marked as a baseline, and a pull force of 22 Newtons (5 pounds) was applied to stretch the segment. The distance between the base mark and the resulting stretch-length mark was then measured. Table 8 shows the amount of stretching attained under the 22 Newton force for the weather strips of Example 1 and Comparative Examples A-C.

TABLE 8

| Example | Stretch distance (centimeters) | Stretch distance (inches) |
|---|---|---|
| Example 1 | 0.160 | 0.063 |
| Comparative Example A | 0.635 | 0.250 |
| Comparative Example B | 0.478 | 0.188 |
| Comparative Example C | 23.81 | 9.375 |

As shown in Table 8, the weather strips of Example 1 and Comparative Examples A and B exhibited very little stretching under the applied force. For the weather strip of Example 1, the low stretchability of the weather strip is believed to be due to the more rigid stem portion, which reduces longitudinal movement (in addition to increasing the ease of insertion, as discussed above). For the weather strips of Comparative Examples A and B, the low stretchabilities of the weather strips are believed to be due to the rigid stem portions.

The weather strip of Comparative Example C, however, exhibited high amounts of stretching. As discussed above, this can increase time and effort required to insert stem portion of the weather strip into a kerf. The high amount of stretching attained with the weather strip of Comparative Example C is due to the use of a soft bulb portion in combination with the soft stem portion, which, as discussed above, also increases the insertion force required insert the stem portion into a kerf.

VIII. Accelerated Weathering Testing

The weather strips of Example 1 and Comparative Examples A-C were also exposed to ultraviolet radiation and weathering conditions, and qualitatively measured for durability. Samples of each of the weather strips were subjected to accelerated weathering using a weathering tester commercially available under the tradename "QUV" Accelerated Weathering Tester from Q-Lab Products, Cleveland, Ohio, pursuant to the QUV portion of the American Architectural Manufacturers Association (AAMA) 702-04 weather strip cycle guidelines, which is also recited under ASTM G154. The samples were removed from the weathering tester at increments of 288 hours, 576 hours, 864 hours, and 1,152 hours and qualitatively analyzed for the effects of the exposure.

The qualitative analysis included (1) a visual, naked-eye inspection for effects of cracking & discoloration, (2) a compression inspection involving compressing the bulb portion of the sample with a pen tip to a nominal compressed operating height and looking for cracks with a 20× microscope, (3) a folded-bulb inspection involving folding the sample into a 180-degree bend using needle nose pliers and looking for cracks with a 20× microscope, and (4) a flaking inspection involving lightly scraping the samples with a finger nail to determine whether the bond integrity of the bulb portion materials remained intact (i.e., observable as scraped off flakes). Based on the qualitative analysis of each sample, for each time increment, a ranking was provided on a scale of 0-10 for the criteria of chalking, cracking/crazing, color shift, and overall general appearance. A ranking of "0" indicated no change, and a ranking of "10" indicated a significant change due to the weathering. Tables 9-12 shows the rankings attained for the weather strips of Example 1 and Comparative Examples A-C for the increments of 288 hours, 576 hours, 864 hours, and 1,152 hours, respectively.

TABLE 9

| Example (288 hours) | Chalking | Cracking/ Crazing | Color shift | General Appearance |
|---|---|---|---|---|
| Example 1 | 0 | 0 | 1 | 1 |
| Comparative Example A | 0 | 0 | 1 | 1 |
| Comparative Example B | 0 | 0 | 3 | 3 |
| Comparative Example C | 0 | 1 | 3 | 3 |

TABLE 10

| Example (576 hours) | Chalking | Cracking/ Crazing | Color shift | General Appearance |
|---|---|---|---|---|
| Example 1 | 0 | 0 | 1 | 1 |
| Comparative Example A | 0 | 0 | 1 | 1 |
| Comparative Example B | 0 | 0 | 3 | 3 |
| Comparative Example C | 0 | 4 | 5 | 5 |

TABLE 11

| Example (864 hours) | Chalking | Cracking/ Crazing | Color shift | General Appearance |
|---|---|---|---|---|
| Example 1 | 0 | 0 | 2 | 2 |
| Comparative Example A | 0 | 0 | 2 | 2 |
| Comparative Example B | 0 | 0 | 2 | 2 |
| Comparative Example C | 0 | 7 | 7 | 7 |

TABLE 12

| Example (1,152 hours) | Chalking | Cracking/ Crazing | Color shift | General Appearance |
|---|---|---|---|---|
| Example 1 | 0 | 0 | 2 | 2 |
| Comparative Example A | 0 | 0 | 2 | 2 |
| Comparative Example B | 0 | 0 | 2 | 2 |
| Comparative Example C | 0 | 9 | 8 | 9 |

As shown in Tables 9-12, the weather strip of Example 1 exhibited good durability after being subjected to all four increments. The results were on par with those attained with the rigid materials of Comparative Examples A and B. In comparison, the EPDM rubber of Comparative Example C showed moderate levels of degradation after the 288 and 576 hour-increments, and high levels of degradation after the 864 and 1,153-hour increments. Thus, the materials used for the weather strips of the present disclosure exhibit substantially higher levels of weatherability compared to the EPDM rubbers used in conventional weather strips. Accordingly, the weather strips of the present disclosure provide good weather seals at sharp corners, while also exhibiting good weatherability for use over extended periods of time.

Although the present disclosure has been described with reference to preferred embodiments, workers skilled in the art will recognize that changes may be made in form and detail without departing from the spirit and scope of the disclosure.

The invention claimed is:

1. A weather strip comprising:

a stem portion configured to secure the weather strip to a frame structure, the stem portion comprising a thermoplastic polymer; and a hollow bulb portion secured to a first end of the stem portion, the hollow bulb portion comprising:

a bulb wall having an inner-facing surface, and comprising a first thermoplastic elastomer that exhibits a Shore A hardness of 20 or less, and that is selected from the group consisting of a thermoplastic vulcanizate material, a styrene-based block copolymer, and combinations thereof; and an inner coating disposed on at least a portion of the inner-facing surface of the bulb wall, wherein the inner coating comprises a second thermoplastic elastomer that exhibits a lower self adhesion relative to a self adhesion exhibited by the first thermoplastic elastomer of the bulb wall, and wherein the second thermoplastic elastomer of the inner coating has a higher durometer than the first thermoplastic elastomeric material of the bulb wall and the second thermoplastic elastomer having a coefficient of friction of 0.50 or less;

wherein a continuous segment of the weather strip is configured to be bent for substantial alignment with a corner of a frame structure having an angle ranging from 60 degrees to 100 degrees.

2. The weather strip of claim 1, wherein the weather strip is configured to exhibit a peak compression force of 3.0 newtons or less when bent for substantial alignment with the corner of the frame structure.

3. The weather strip of claim 2, wherein the peak compression force that the weather strip is configured to exhibit is 2.5 newtons or less.

4. The weather strip of claim 1, wherein the first thermoplastic elastomer exhibits a Shore A hardness of 15 or less.

5. The weather strip of claim 1, wherein the hollow bulb portion further comprises an outer coating disposed on at least a portion of an outer facing surface of the bulb wall, wherein the outer coating comprises a material that exhibits a lower self adhesion relative to the self adhesion exhibited by the first thermoplastic elastomer of the bulb wall, and wherein the material of the outer coating further exhibits a coefficient of friction of 0.50 or less.

6. The weather strip of claim 1, wherein the second thermoplastic elastomer of the inner coating exhibits a Shore D hardness of 75 or less.

7. The weather strip of claim 1, wherein the thermoplastic elastomer comprises the thermoplastic vulcanizate and the styrene-based block copolymer, and wherein the styrene-based block copolymer comprises a styrene-ethylbutylene-styrene block copolymer.

8. A weather strip comprising:

a stem portion configured to secure the weather strip to a frame structure the stem portion comprising a thermoplastic polymer; and a hollow bulb portion secured to a first end of the stem portion, the hollow bulb portion comprising:

a bulb wall having an inner-facing surface, and comprising a first thermoplastic elastomer having a Shore A hardness of 20 or less, wherein the first thermoplastic elastomer is selected from the group consisting of a thermoplastic vulcanizate material, a styrene-based block copolymer, and combinations thereof; and an inner coating disposed on at least a portion of the inner-facing surface of the bulb wall, the inner coating comprising a second thermoplastic elastomer that exhibits a lower self adhesion relative to a self adhesion exhibited by the first thermoplastic elastomer of the bulb wall, wherein the second thermoplastic elastomer of the inner coating has a higher durometer than the first thermoplastic elastomer of the bulb wall and the second thermoplastic elastomer having a coefficient of friction of 0.50 or less.

9. The weather strip of claim 8, wherein the hollow bulb portion has an outer diameter and an inner diameter, and wherein a ratio of the outer diameter to the inner diameter ranges from 1.0 to 3.0.

10. The weather strip of claim 9, wherein the ratio of the outer diameter to the inner diameter ranges from 1.2 to 2.5.

11. The weather strip of claim 8, wherein the hollow bulb portion further comprises an outer coating disposed on at least a portion of an outer-facing surface of the bulb wall, the outer coating comprising a material that exhibits a lower self adhesion relative to the self adhesion exhibited by the first thermoplastic elastomer of the bulb wall, and wherein the material of the outer coating further exhibits a coefficient of friction of 0.50 or less.

12. The weather strip of claim 8, wherein the first thermoplastic elastomeric material comprises the thermoplastic vulcanize and the styrene-based block copolymer, and wherein the styrene-based block copolymer comprises a styrene styrene-ethylbutylene-styrene block copolymer.

13. The weather strip of claim 8, wherein the first thermoplastic elastomer of the bulb wall exhibits a Shore A hardness of about 15 or less.

* * * * *